US006203085B1

(12) United States Patent
Ferris

(10) Patent No.: US 6,203,085 B1
(45) Date of Patent: Mar. 20, 2001

(54) DEVICE FOR FACILITATING THE LOADING OF STRETCHER UNDERCARRIAGES INTO AMBULANCES

(75) Inventor: Alan Keith Ferris, Brendale (AU)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 09/353,510

(22) Filed: Jul. 14, 1999

(30) Foreign Application Priority Data

Jul. 16, 1998 (AU) ..... PP4699

(51) Int. Cl.[7] ..... A61G 3/00; A61G 3/02; A61G 3/06; A61G 1/02; A61G 1/00

(52) U.S. Cl. ..... 296/20; 5/625

(58) Field of Search ..... 296/19, 20; 5/625, 5/626

(56) References Cited

U.S. PATENT DOCUMENTS

| | | | | |
|---|---|---|---|---|
| 2,319,008 | * | 5/1943 | McCormack | 296/20 |
| 3,088,770 | | 5/1963 | Weil et al. . | |
| 3,752,527 | * | 8/1973 | Ferneau et al. | 296/20 |
| 3,759,565 | * | 9/1973 | Ferneau | 296/20 |
| 3,826,528 | * | 7/1974 | East | 296/20 |
| 4,645,222 | * | 2/1987 | Hester | 280/5.26 |
| 4,790,548 | * | 12/1988 | Decelles et al. | 280/5.26 |
| 4,794,999 | * | 1/1989 | Hester | 180/8.2 |
| 5,015,024 | * | 5/1991 | Bloemer | 296/20 |
| 5,435,027 | * | 7/1995 | Bourgraf et al. | 296/20 |
| 5,509,159 | * | 4/1996 | Du-Bois | 296/20 |
| 5,572,756 | * | 11/1996 | Muuranen et al. | 296/20 |
| 5,579,857 | * | 12/1996 | Abe et al. | 180/8.2 |
| 5,975,225 | * | 11/1999 | Kamen et al. | 180/7.1 |

FOREIGN PATENT DOCUMENTS

| | | | | |
|---|---|---|---|---|
| 2651039 | * | 5/1978 | (DE) | 296/20 |
| 3711048 | * | 10/1988 | (DE) | 296/20 |
| 3734902 | * | 4/1989 | (DE) | 296/20 |
| 2 303 504 | | 10/1976 | (FR) . | |
| 2 558 056 | | 7/1985 | (FR) . | |
| 2 664 495 | | 1/1992 | (FR) . | |

* cited by examiner

*Primary Examiner*—D. Glenn Dayoan
*Assistant Examiner*—Hilary Gutman
(74) *Attorney, Agent, or Firm*—Killworth, Gottman, Hagan & Schaeff, LLP

(57) ABSTRACT

A fitting is provided which facilitates the loading of a stretcher onto a platform, such as the bay of an ambulance. The fitting includes a pivotable mounting having a trailing larger diameter wheel and a leading smaller diameter wheel. Pivoting is such that the leading wheel is adapted to ride up onto the platform and then pivot downwardly allowing the trailing wheel to ride up over the rear edge of the platform as the stretcher is pushed into the ambulance. A skid block is preferably formed integrally with the mounting.

13 Claims, 2 Drawing Sheets

DEVICE FOR FACILITATING THE LOADING OF STRETCHER UNDERCARRIAGES INTO AMBULANCES

BACKGROUND OF INVENTION

This invention relates to patient transporting equipment, particularly stretcher undercarriages and equipment of a similar nature. The invention is concerned with an arrangement for fitting to the leading end of such equipment in order to facilitate the manual loading of the equipment, either with or without a patient, onto the elevated loading bays of ambulances or other elevated platforms whose heights from the ground or base level on which the transporting equipment is supported can vary. Since the invention is primarily concerned with stretcher undercarriages, it will be described in that context. However, as the invention is by no means limited to use with such equipment, the broader applications and ramifications are to be borne in mind when considering the intended scope of the invention.

Stretcher undercarriages typically comprise an essentially rectangular patient support frame with collapsible wheeled leg assemblies enabling the stretcher to be stowed or loaded into the back of an ambulance. To assist such stowage or loading, the leading end of the patient support frame is fitted with wheels so that the undercarriage can slide up over the rear edge of the ambulance loading bay and be slid into the ambulance during simultaneous folding of the wheeled legs.

Difficulties are encountered with the stowage of stretcher undercarriages when the height of the ambulance bay floor is above the central axles of the leading end wheels on the support frame. In such situations, the trailing end of the stretcher undercarriage must be tilted so that the wheels can ride up over the rear edge of the ambulance bay. This places strain on the attendant who must be able to withstand the additional rearwardly directed loads created upon tilting. Strains and stresses are also placed on the patient as well as the stretcher undercarriage itself. Accordingly, there remains a need in the art for an arrangement for fitting to stretcher undercarriages and like equipment which obviates or at least ameliorates such difficulties.

SUMMARY OF THE INVENTION

In accordance with one aspect of the present invention, there is provided an arrangement for facilitating the loading of a stretcher undercarriage into the loading bay of an ambulance, the arrangement comprising a pair of wheeled devices for fitting to opposed stretcher undercarriage frame members at or near the top leading edges thereof. Each of the wheeled devices comprises a pivotable mounting on which a leading wheel and a trailing wheel are co-planarly supported in such a manner that the leading wheel can ride onto an ambulance floor and pivot downwardly, thereby permitting the trailing wheel to ride up over the rear edge of the ambulance floor as the stretcher undercarriage is pushed into the bay of the ambulance.

Preferably, a skid block extends between the leading wheel and the trailing wheel to facilitate the movement of the mounting up over the rear edge of the ambulance floor. The skid block, which can suitably be fabricated, for example, from a high density polymeric material, is typically located so as to extend from the axle region of the leading wheel to a location below the axle region of the trailing wheel. The skid block enables the leading wheel to slide over the rear edge of the ambulance floor to a position where its axle ends up below the axle of the trailing wheel so that the arrangement can pivot and "climb".

The pivotable mounting may be in the form of a pair of closely spaced metal plates, with integrally formed skid blocks, in which the wheels are housed and from which the wheels project. Suitably, the wheels project to such an extent that a major portion of their surface contacting edges is visible. The plates can have any configuration to achieve the desired aim. One particular configuration is an irregular quadrilateral configuration.

Pivoting of the mounting can be effected about a common axle extending through a casting or the like which is fitted onto the normally tubular stretcher frame. A limit to the degree of pivoting can be provided by one or more, preferably two stops, associated with the mounting. In one form such stops can be pins which extend between the metal plates in the upper region thereof, one pin being located toward the trailing end of the mounting and the other pin being located between and above the axles of the wheels. Upward travel of the mounting can thereby be resisted by the respective pins coming into contact with the tubular stretcher frame.

Preferably, the pivotable mounting is arranged in such a manner that the leading wheel is normally maintained in a forwardly projecting location with the mounting extending rearwardly thereof, when the stretcher undercarriage is in a position prior to loading into an ambulance. This arrangement can be achieved by careful balancing of the components or, more preferably, by spring biasing. In this latter instance, a torsion or like spring mechanism can be secured to the pivotable mounting and extend about the pivot point to a remote point on the mounting, such as the forward pin stop.

The leading and trailing wheels can be wheels of the type which are conventionally found on stretcher undercarriages. Although not essential, the leading wheel is preferably a smaller diameter wheel than the trailing wheel. This greatly facilitates the design and operation of the device.

The arrangement need not be separately attachable to the stretcher undercarriage but can be formed as an integral component of the undercarriage during its manufacture. Generally, however, the arrangement will be manufactured and sold as a kit for attachment to existing stretcher undercarriages.

As previously mentioned, it is also to be borne in mind that the device is applicable to any load bearing wheeled arrangement which is similarly required to be placed on a raised platform, and that the description in relation to stretcher undercarriages and ambulances is merely by way of exemplification of the inventive concept, as is not limited thereto. Accordingly, it is a feature of the present invention to provide an arrangement for fitting to stretcher undercarriages and like equipment which obviates or at least ameliorates stresses and strains associated with the loading and unloading of stretcher carriages. This, and other features and advantages of the present invention, will become apparent from the following detailed description, the accompanying drawings, and the appended claims.

DETAILED DESCRIPTION OF THE PREFERRED EMBODIMENT

Figure 1:
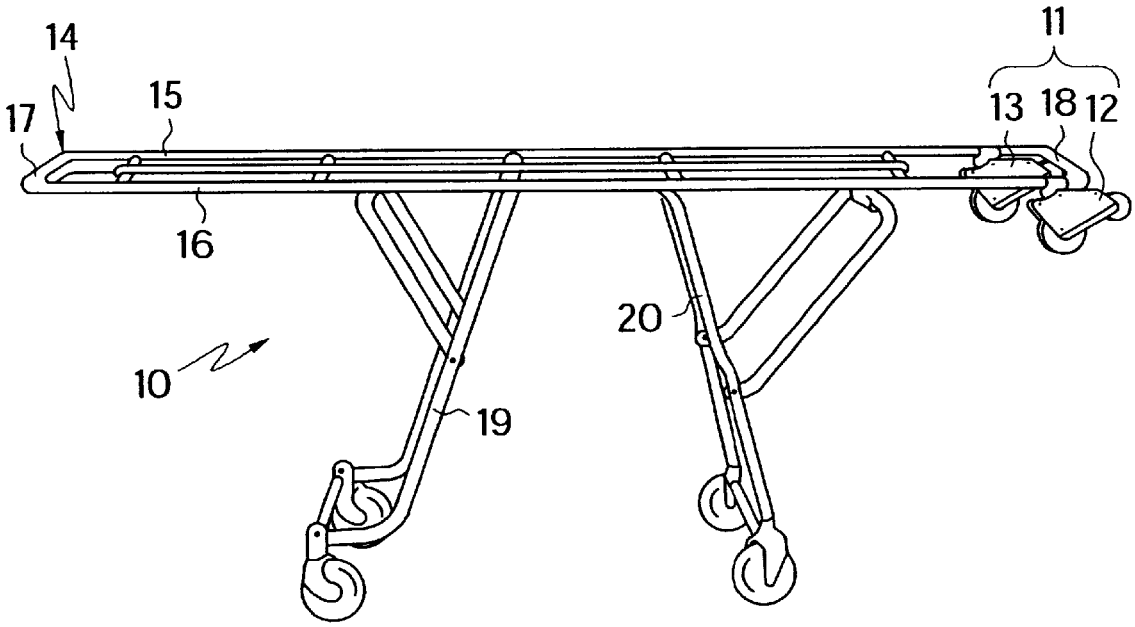
FIG. 1 is an elevational view of a stretcher undercarriage incorporating a load facilitating arrangement according to the present invention.

A preferred embodiment of the invention will now be described by way of example with reference to the accompanying drawings, in all of which like reference numerals refer to like parts.

Referring now to FIG. 1, there is shown a stretcher undercarriage indicated generally by arrow 10 and a load facilitating arrangement indicated generally by arrow 11. The load facilitating arrangement comprises a pair of wheeled devices 12, 13 fitted to the forward upper end of the stretcher undercarriage (by forward end is meant the end which first enters the ambulance).

The stretcher undercarriage comprises a tubular framework of conventional design, having a patient support platform 14 defined by longitudinal members 15, 16 and cross members 17, 18; and a pair of collapsible wheeled supports 19, 20, which are designed to fold up under the patient support platform when it is loaded into an ambulance.

Figure 2:
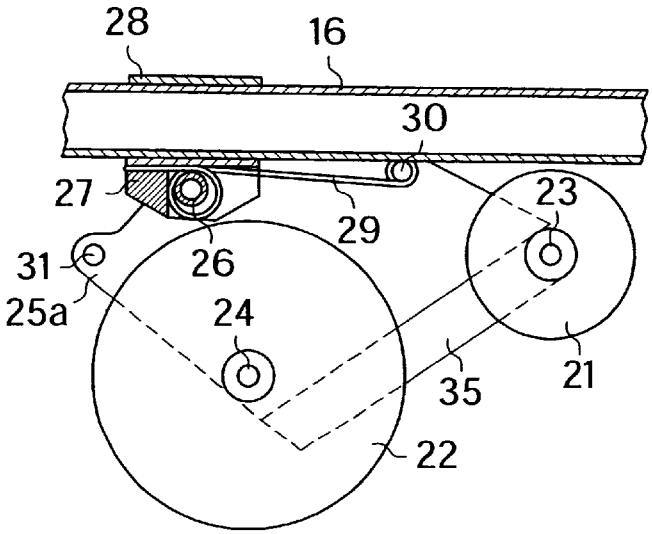
FIG. 2 is a partial cross-sectional view of one wheeled device of the load facilitating arrangement depicted in FIG. 1.
Figure 3:
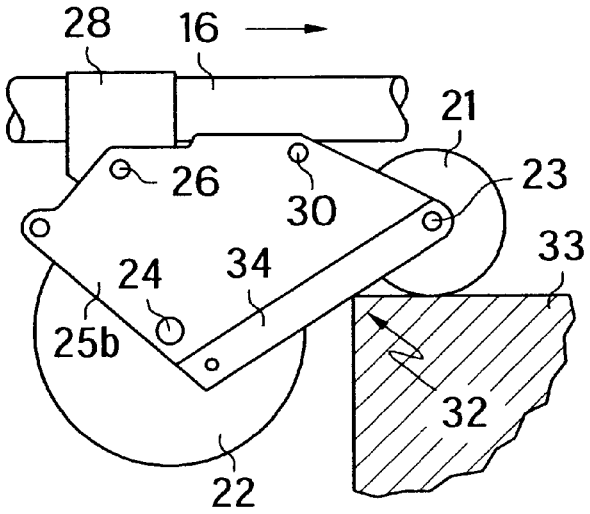
FIG. 3 is an elevational view of the wheeled device depicted in FIG. 2 in one orientation.

A cross-sectional elevation of the wheeled support device 12 is shown in FIG. 2 to which reference is now made. The device comprises a leading wheel 21 and a larger diameter trailing wheel 22 supported on respective axles 23, 24 extending between metal plates, only one of which, namely, the rear plate 25*a*, is illustrated in FIG. 2—the other, namely the front plate 25*b* is illustrated in FIGS. 3 and 4.

The metal mounting plates 25*a*, 25*b* are pivotally connected by a pin 26 to a housing 27 which is an integral part of a sleeve 28 which in turn is removably attachable to the longitudinal member 16 of the stretcher undercarriage. Housing 27 also accommodates the end of a torsion spring 29 which extends out and around a pin 30 connecting the two metal mounting plates. This pin 30 also acts as a stop by pressing against the longitudinal member 16 to thereby prevent the wheeled support device from rotating counter clockwise past the position illustrated in FIGS. 2 and 3.

Figure 4:
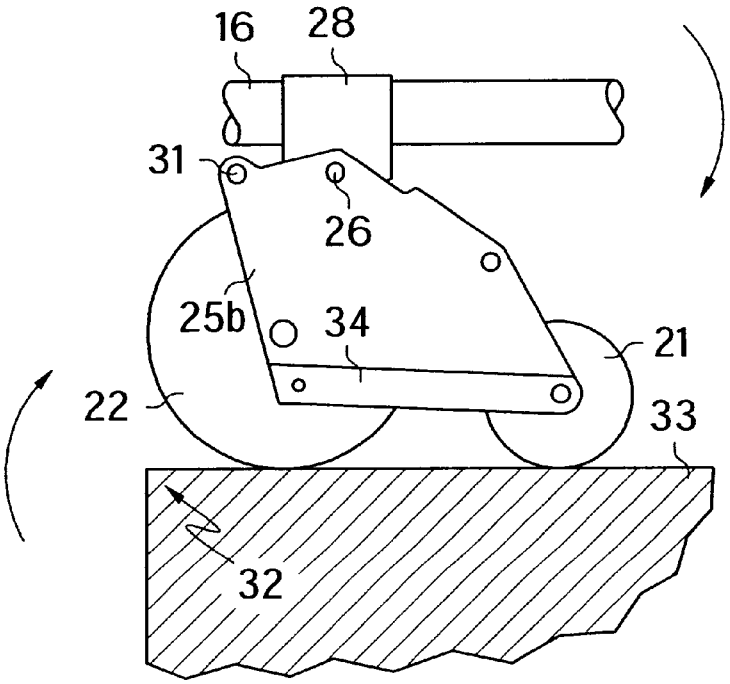
FIG. 4 is an elevational view of the wheeled device depicted in FIG. 3 in another orientation.

A second pin 31 similarly acts as a stop but this time to prevent the wheeled device from rotating in a clockwise position too much further than as depicted in FIG. 4.

The lower section of each metal mounting plate has an integrally formed skid block 34, 35 of a polymeric material. The skid blocks extend below the axle 24 of the trailing wheel 22 and around the axle 23 of the leading wheel 21.

In use, the arrangement operates substantially as indicated in FIGS. 3 and 4, to which reference is now made. In these drawings, reference numeral 32 indicates the upper rear edge of the ambulance floor onto which the stretcher undercarriage is being loaded. As shown in FIG. 3, the floor 33 of the ambulance loading bay is higher than the normal axle height of a wheel on a conventional stretcher undercarriage. However, the leading wheel 21 of the device can easily ride onto the ambulance floor and in so doing enable the trailing wheel 22 to easily ride up and over the rear edge 32 of the ambulance floor in the direction indicated by the large flow arrow in FIG. 3, until the position shown in FIG. 4 is reached. Simultaneously, the entire device pivots about the pivot pin 26 until both wheels are on the ambulance floor 33. The wheels remain in contact with the floor due to the downward load exerted thereon by the weight of the stretcher undercarriage.

It is to be understood that in the particular embodiment illustrated, which is preferred for situations where the ambulance floor 33 is just below the height range of the leading wheel 21 but above the axle of the trailing wheel 22, the skid blocks 34, 35 assist the wheeled devices 12,13 to slide over the rear edge 32 of the ambulance floor to a position below the trailing wheel axle 24 and thereby enable the devices to pivot and climb over the rear edge.

In this manner, the difficulties encountered with the loading and stowage of stretcher undercarriages of the type previously referred to are obviated with ease.

It is to be understood that the term "stretcher undercarriage" as used throughout the specification is intended to mean the combination of a patient carrying platform and a wheeled collapsible support frame. Further, while the above detailed description has been given by way of illustrative example of the invention, many modifications and variations may be made thereto by persons skilled in the art without departing from the broad scope and ambit of the invention as herein set forth.

What is claimed is:

1. A stretcher undercarriage adapted to ride tip over an edge of a surface, comprising, a patient support platform including opposed frame members having a top leading edge and a pair of collapsible wheeled supports, and an arrangement comprising a pair of individually pivotable wheeled devices fitted to said opposed stretcher undercarriage frame members adjacent said top leading edge thereof, wherein each of said devices comprises a pivotable mounting on which a leading wheel and a trailing wheel are co-planarly supported in such a manner that the leading wheel is adapted to ride onto the edge of the surface and then pivot downwardly permitting the trailing wheel to ride up over the edge as the stretcher undercarriage is pushed.

2. The arrangement for facilitating loading of a stretcher undercarriage onto a surface over an edge thereof, the stretcher undercarriage having opposed frame members with a top leading edge, said arrangement comprising:

a pair of individually pivotable wheel support devices mountable to the opposed frame members adjacent the top leading edge thereof wherein each of said devices comprises:

a leading wheel;

a trailing wheel; and, a pivotable mounting co-planarly supporting said leading and trailing wheels in such a manner that said leading wheel is adapted to ride onto said surface and then pivot downwardly permitting the trailing wheel to ride up over said edge as the stretcher undercarriage is pushed.

3. The arrangement as claimed in claim 2, wherein said mounting further includes a skid block between said leading wheel and the trailing wheel.

4. The arrangement as claimed in claim 3, wherein said skid block is fabricated from a polymeric material and extends from the axis of said leading wheel to a location below the axis of said trailing wheel.

5. The arrangement as claimed in claim 4, wherein the diameter of said leading wheel is between 25% and 75% of the diameter of said trailing wheel.

6. The arrangement as claimed in claim 5, wherein the diameter of said leading wheel is approximately 50% the diameter of said trailing wheel.

7. The arrangement as claimed in claim 2, wherein said pivotable mounting comprises a pair of spaced plates in which said leading and trailing wheels are housed and from which said leading and trailing wheels project.

8. The arrangement as claimed in claim 2, wherein said mounting is pivotable on a common axle extending into an attachment to said stretcher undercarriage.

9. The arrangement as claimed in claim 2, wherein the degree of pivoting of said mounting relative to said stretcher undercarriage is limited by pins, a first pin being located toward the trailing end of said mounting and a second pin being located between and above the axles of said wheels.

10. The arrangement as claimed in claim 2, wherein said mounting comprises a pair of mounting plates that are pivotally connected by a pin to a housing which is integral to a sleeve removably attached to one of the opposed frame members.

11. The arrangement as claimed in claim 10, wherein a second pin further connects said mounting plates, and said housing accommodates a first end of a torsion spring which extends out and around said second pin.

12. An arrangement for facilitating loading a leading edge of a stretcher undercarriage having upper opposed frame members over an edge and onto a loading bay floor of an ambulance, said arrangement comprising:

a pair of wheeled devices for fitting to the frame members adjacent the leading edge of the stretcher undercarriage, wherein each of said wheeled devices comprises:

an attachment for one of said opposed frame member;

a mounting on which a leading wheel and a trailing wheel are co-planarly supported in such a manner that said leading wheel is adapted to ride onto the floor and then pivot downwardly permitting said trailing wheel to ride up over the edge as the stretcher is loaded into the ambulance; and a common axle extending into said attachment, said mounting being pivotable on said common axle.

13. The arrangement as claimed in claim 12, wherein said mounting further includes a first pin and a second pin, wherein said pins are located in such a manner to limit the degree of pivoting of said mounting relative to the stretcher undercarriage.

* * * * *

UNITED STATES PATENT AND TRADEMARK OFFICE

CERTIFICATE OF CORRECTION

PATENT NO. : 6,203,085 B1
DATED : May 11, 2001
INVENTOR(S) : Alan Keith Ferris

It is certified that error appears in the above-identified patent and that said Letters Patent is hereby corrected as shown below:

Column 4,
Line 21, "to ride tip over" should read -- to ride up over --.
Line 35, "The arrangement" should read -- An arrangement --.
Line 42, "edge thereof wherein" should read -- edge thereof, wherein --.

Column 5,
Line 7, "toward the trailing" should read -- toward a trailing --.

Column 6,
Line 5, "frame member" should read -- frame members --.

Signed and Sealed this

Eighth Day of January, 2002

*Attest:*

*Attesting Officer*

JAMES E. ROGAN
*Director of the United States Patent and Trademark Office*